US008813736B2

(12) United States Patent
Gilbertson

(10) Patent No.: US 8,813,736 B2
(45) Date of Patent: Aug. 26, 2014

(54) SPORT BLOW GUN

(71) Applicant: Gary C. Gilbertson, Northfield, MN (US)

(72) Inventor: Gary C. Gilbertson, Northfield, MN (US)

( * ) Notice: Subject to any disclaimer, the term of this patent is extended or adjusted under 35 U.S.C. 154(b) by 51 days.

(21) Appl. No.: 13/734,184

(22) Filed: Jan. 4, 2013

(65) Prior Publication Data

US 2013/0167820 A1 Jul. 4, 2013

Related U.S. Application Data

(60) Provisional application No. 61/631,397, filed on Jan. 4, 2012.

(51) Int. Cl.
*F41B 1/00* (2006.01)

(52) U.S. Cl.
USPC ..... 124/62; 124/60

(58) Field of Classification Search
CPC ..... F41B 1/00
USPC ..... 124/60, 62
See application file for complete search history.

(56) References Cited

U.S. PATENT DOCUMENTS

| | | | | | |
|---|---|---|---|---|---|
| 863,753 | A * | 8/1907 | Pike | 124/62 |
| 1,290,050 | A * | 1/1919 | Bay et al. | 124/62 |
| 2,679,838 | A * | 6/1954 | Thompson | 124/62 |
| 3,388,696 | A * | 6/1968 | Hoverath et al. | 124/62 |
| 4,054,120 | A * | 10/1977 | Foley | 124/62 |
| 4,586,482 | A | 5/1986 | Di Pietro | |
| 5,718,214 | A * | 2/1998 | Altman et al. | 124/62 |
| 8,297,268 | B2 * | 10/2012 | Kenworthy | 124/62 |
| 2013/0213377 | A1 * | 8/2013 | Kenworthy | 124/62 |

* cited by examiner

*Primary Examiner* — Bret Hayes
*Assistant Examiner* — Derrick Morgan

(57) ABSTRACT

A sport blow gun is a blow gun which is a tube with a bore, a loading end and a muzzle end. A projectile is inserted into the loading end and blown out the muzzle end by the user's breath. The main tube features a safety device which prevents a projectile from falling out of the tube or being inhaled. One type of projectile fired from the blow gun is a dart which is usually comprised of foam or soft material, and may also be made out of a material which causes relatively little resistance as it passes through the bore, yielding higher velocity. The projectile may also be coated with a coating which reduces resistance with the bore. Projectiles may also be modified in form for aerodynamic efficiency.

8 Claims, 8 Drawing Sheets

SPORT BLOW GUN

RELATED APPLICATION

The present application claims the benefit of U.S. Provisional Application No. 61/631,397 filed Jan. 4, 2012, which is incorporated herein in its entirety by reference.

BACKGROUND OF THE INVENTION

1. Field of the Invention

The present invention relates to blow guns used for sport and games, specifically the safety and accuracy features of such blow guns and projectiles associated with said blow guns.

2. Prior Art

Blow guns have been known for hundreds of years and used both as weapons and for games and entertainment. Some blowguns even fire foam darts and marshmallows and implement a variety of safety features such as an aperture which prevents a projectile from being loaded into the end of the gun which the user applies their mouth to blow, instead requiring a projectile be loaded in from the end of the gun which the projectile passes out of when fired. This and other safety features result in a cumbersome loading process, and do not always keep the projectile within the blow gun when the blow gun is tipped or jolted.

A variety of foam projectile launching devices and foam projectile designs have been popular toy items for decades. While there are a great variety of projectiles, there are no dart-type projectiles which incorporate a spiral or rifling pattern upon the dart itself or other feature designed to enhance aerodynamic stability of dart-type projectiles, beyond simply streamlining the form of such projectiles in order to decrease wind resistance. Further, dart-type projectiles are normally not comprised of a material which decreases resistance within the bore of a blowgun, nor are they normally designed to fit with a tight tolerance between the bore and the projectile. The combination of a smooth projectile and a tight tolerance between bore and projectile yields too high of a projectile velocity to allow for good in-flight projectile stability without a carefully designed projectile, and thus has never been attempted in the arena of sport blowguns.

SUMMARY OF THE INVENTION

This sport blow gun of my invention provides unmatched safety and ease of use together in one unique design due to its innovative safety device which allows a projectile to be inserted into the end of a blow gun closest to the user's mouth, as opposed to having to load the projectile in through the forward muzzle of a blow gun by which the projectile exits when properly used. This allows for a much faster rate-of-fire. Further, the safety device creates a force against a projectile which it is in contact with, which keeps the projectile from falling out of the blow gun.

Normally, a similar safety device requires a different loading method, such as loading the projectile from the end farthest from the user, and does not keep the projectile in place once loaded. This sport blow gun also features a tight tolerance between its bore and its projectiles as well as a tight tolerance between its bore and those projectiles commonly available for similar blow guns, which results in a better seal between bore and projectile, making a more full use of the user's breath, thereby propelling the projectile at a greater velocity than otherwise possible. This tight tolerance is unique to this invention, and has, in the past, been avoided due to the potential for the projectile to become stuck within the bore. This event may occur when such a tight tolerance is present, but usually occurs in warm, humid weather or due to moisture of the user's breath after many uses of the blow gun. This invention, however, features a series of projectiles which, due to their composition or coating, provide a smooth surface which resists sticking within the bore of the blowgun, thereby making an effective combination of blow gun and projectile, yielding unusually high velocity with safety and ease of use.

This invention also features a variety of projectiles which have features providing increased aerodynamic stability above-and-beyond what has historically been seen in the field of blow guns used for sport or entertainment. One such projectile features a set of fins, and another features rifling upon the dart, usually only seen in the barrel of a rifle or cannon. This rifling puts the projectile into a spin as it passes through the air, increasing its accuracy. Another projectile type has a carefully designed circular Velcro-tipped 'head' which overcomes certain shortcomings of previously known dart-type projectiles that also utilize Velcro due to a reduced amount of Velcro needed to achieve the same or better adherence to Velcro-receiving targets, while providing increased aerodynamic stability and accuracy because of an inherently more uniform design.

DETAILED DESCRIPTION OF THE DRAWINGS

Figure 6:
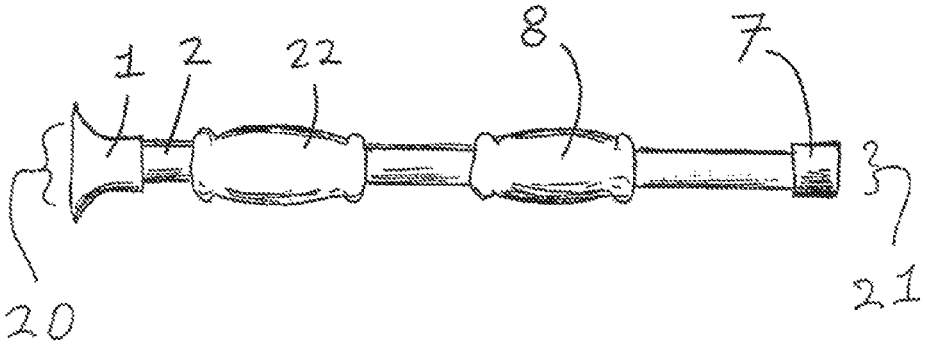
FIG. 6 is a side view of an embodiment of the invention of the sport blow gun.

The sport blow gun of the present invention includes a blow gun and projectiles. The blow gun of the present invention is seen in FIG. 6 with optional hand guards and a mouthpiece as well as an endpiece. The blowgun features a safety device 3, which serves two purposes: First, it holds the projectile in place if inserted at least as far as the safety device tip. Second, it provides a very important safety feature. When the projectile is inserted without a safety device, there is a chance of the projectile being inhaled by the user. With the safety device in place, the projectile is held in position and is not easily removed from the loading end without considerable force. The common design of the projectile further enhances the effectiveness of the safety device as the forward portion of the projectile is usually larger than the trailing portion, resulting in a lip which the safety device may push against, making it nearly impossible to remove the projectile from the loading end without destroying the projectile in the process.

Figure 1:
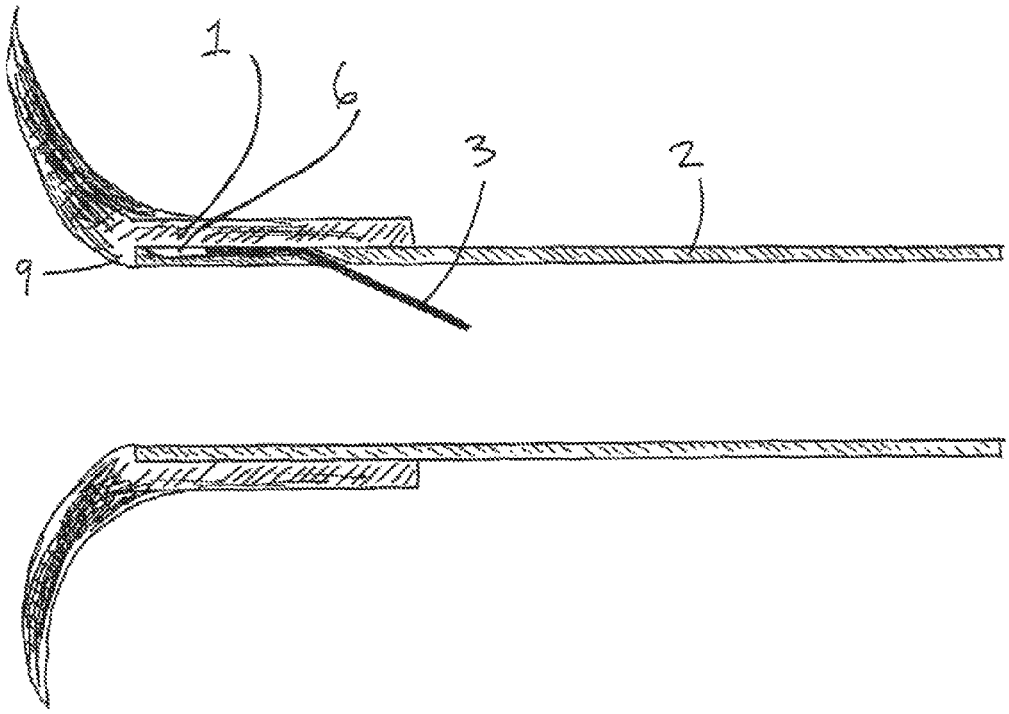
FIG. 1 is a side cross-section view of the embodiment of the invention showing one embodiment of the safety device.
Figure 2:
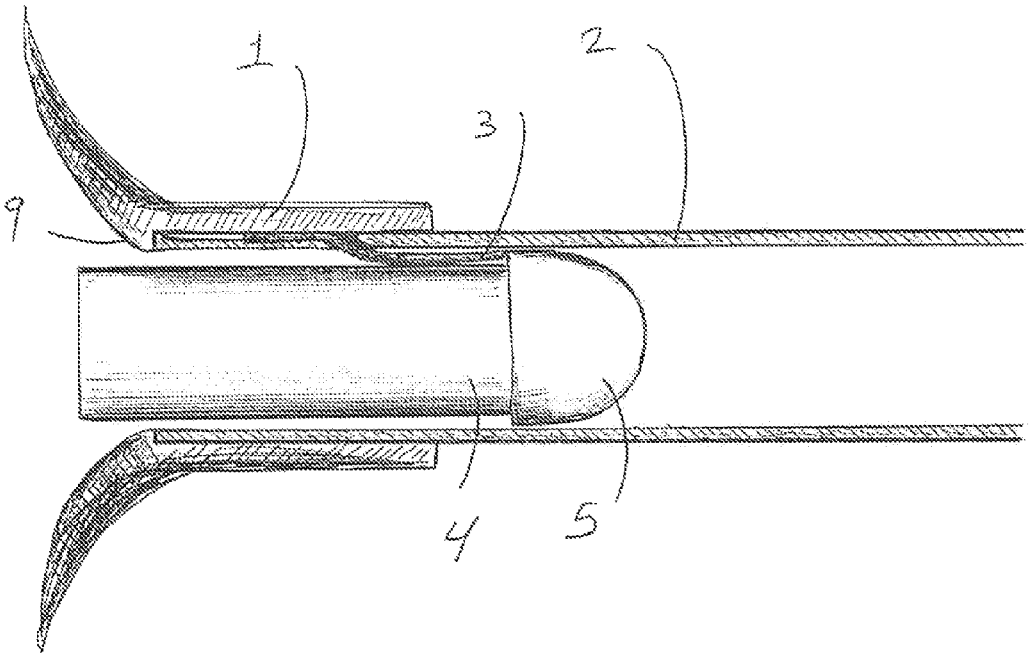
FIG. 2 is a side cross-section view of the embodiment of the invention showing one embodiment of the safety device interacting with a loaded projectile.
Figure 3:
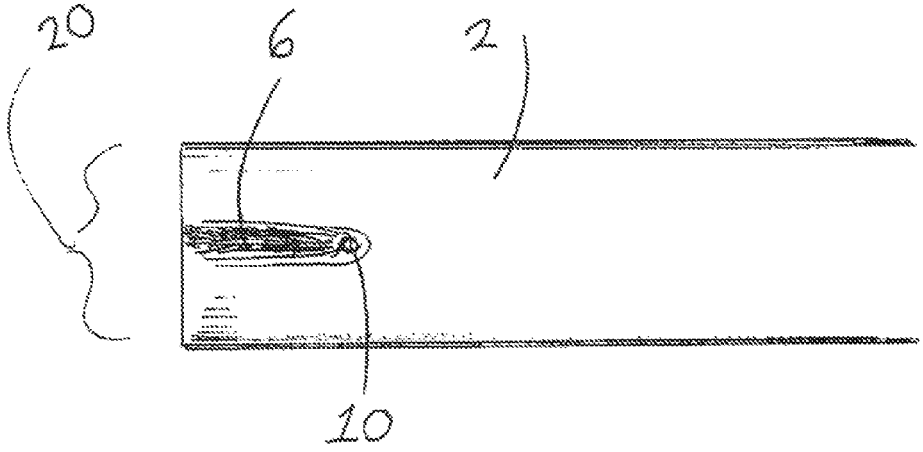
FIG. 3 is a top view of an embodiment of the invention with some parts deleted for clarity, showing the groove and hole for one embodiment of the safety device.

An embodiment of the safety device with an empty bore is seen in FIG. 1, and an embodiment of the safety device with a loaded projectile is seen in FIG. 2. The safety device is usually inserted lengthwise from the exterior of the main tube into the interior of the main tube through a hole in the wall of the main tube 10. The hole is usually approximately 0.0625 inches in diameter, through which the safety device is inserted. In one version of the safety device which features a hole created in the body of the tube, a groove 9 is cut into the surface of the tube 2, which may be, but is not limited to, approximately 0.0625 inches in width, approximately 0.03 to 0.06 inches in depth, and approximately 0.5 inches to 1 inch in length. It usually begins at the origin of the loading end and extends towards the muzzle end, parallel with the main tube's central axis, as seen in FIG. 3.

The hole 10 is usually within 1 inch of the loading end, often being drilled within the groove 6 that is first cut into the main tube 2 surface. The projectile restrainer 3 may be comprised of plastic or other similar material, with a width usually ranging from, but not limited to, approximately 0.03 inches to approximately 0.06 inches, and a height usually ranging from, but not limited to, approximately 0.03 inches to approximately 0.06 inches, and a length usually ranging from, but not limited to, approximately 0.75 inches to approximately 1 inch. The safety device is usually inserted at an angle, usually pointing generally towards the muzzle end, usually diverging from the inner wall of the main tube 2 at an angle ranging from approximately 15 degrees to approximately 30 degrees. The safety device is inserted to two-thirds its length in most cases, while the remaining one-third may remain exposed on the outer surface of the main tube.

If so situated, glue is applied to the groove 6 that was initially cut, and any portion of the safety device which is exposed on the outer surface of the tube is then pushed down into the glue and dries in that position, seated within the groove and solidly held in place as seen in the cross section in FIGS. 1 and 2. The safety device is thus secured. An excellent adherent is silicon glue, because it sticks to the tube and safety device, but not a mouthpiece if fitted over the tube. While silicon glue is disclosed as the preferred embodiment, the safety device may be secured to the tube via other known methods such as heat welding.

A mouthpiece 1 may be attached by pushing said mouthpiece on over the tube at the loading end 20, and a tip 7 may be attached by pushing said tip on over the muzzle end 21. Said mouthpiece and said tip both slide onto said main tube until they cannot be pushed on any further due to the construction of said mouthpiece and said tip, having a lip which does not allow the mouthpiece or tip to slide fully onto the tube 2. The lip 9 of the mouthpiece 1 is shown in FIGS. 1 and 2. The lip of the tip is similar in form and function. The mouthpiece and tip of the preferred embodiment of the present invention are normally made from a molded rubber, which can be easily hand-washed or placed in a dishwasher to clean and disinfect. The mouthpiece and tip can also be made from other resilient materials such as foam or plastic that hold their form but are somewhat pliable to prevent harm to the user or others that come into contact with the blowgun.

The blow gun may also feature grips that slide onto the barrel during construction. The grips of the preferred embodiment are fixed in place to provide a firm grip by which a user may hold the blow gun during reloading or propelling a dart. The grips may also be made of molded rubber, foam or plastic similar to the mouthpiece and tip.

Also claimed are projectiles which pass more freely through the tube of the sport blow gun or other similar blowguns due to the material the projectiles are comprised of or a coating which has been applied to them.

Figure 4:
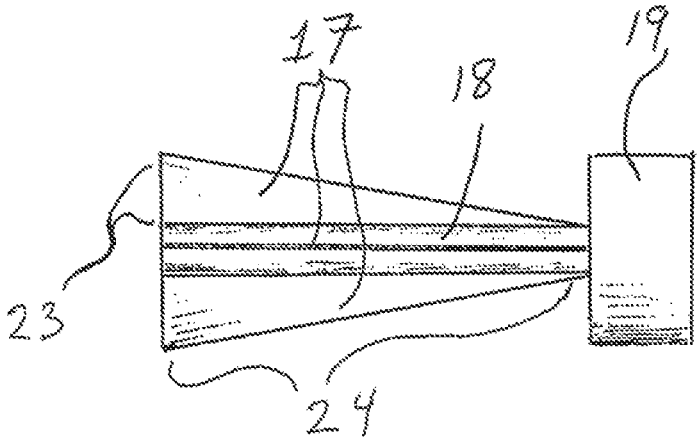
FIG. 4 is a side view of an embodiment of a projectile as a finned projectile.

Also claimed are projectiles comprised of a trailing portion 4 and a forward portion 5, as seen in FIG. 2. The trailing portion is usually foam but can be made out of molded plastic or soft rubber, and is usually smaller in diameter than the forward portion. The trailing portion may have fins, as seen in FIG. 4, which shows a projectile with a trailing portion 18 having four generally symmetrical fins mounted upon it, three of which are visible 17. These fins may be made of many materials but most often are soft rubber, foam or plastic. They can be formed from a mold, or cut out of a thin sheet of a material, and are adhered by various means including gluing.

Each fin is generally in the shape of a right triangle, and in some cases, has a base side, a rearward side, and a leading edge side, said base side attaching to the trailing portion parallel to said trailing portion's central axis, having a front point and a rear point, said base side being linear between said front point and said rear point, said rearward side perpendicular to said trailing portion's central axis, extending outward from the central axis of said trailing portion approximately 0.15 inches, said rearward side having a top point and a base point, said base point corresponding with said rear point, said leading edge side having a edge point and a tip point, said edge point corresponding with said top point, said tip point corresponding with said front point, each edge being linear, said base side having a length similar to the length of said trailing portion, said fins having a thickness of no more than 3 millimeters.

In some cases, a projectile such as that in FIG. 4 may be entirely plastic and may be made from a mold. The forward portion of all said projectiles is usually foam 16, but can be soft rubber 5, or molded plastic 19 as shown in FIG. 4. The forward portion is very close in diameter to the inner bore of the blow gun, even potentially identical in diameter.

Figure 5:
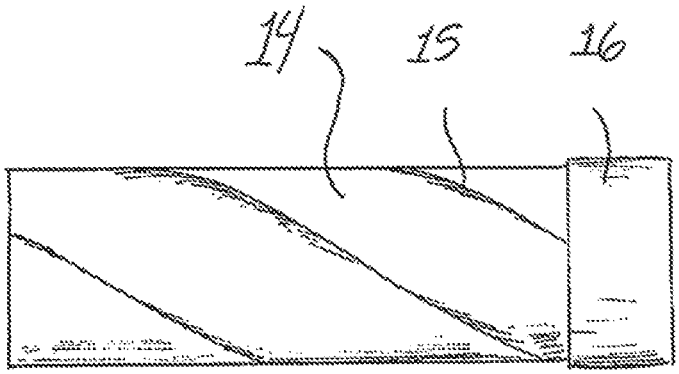
FIG. 5 is a side view of an embodiment of a projectile as a helically indented projectile.
Figure 7:
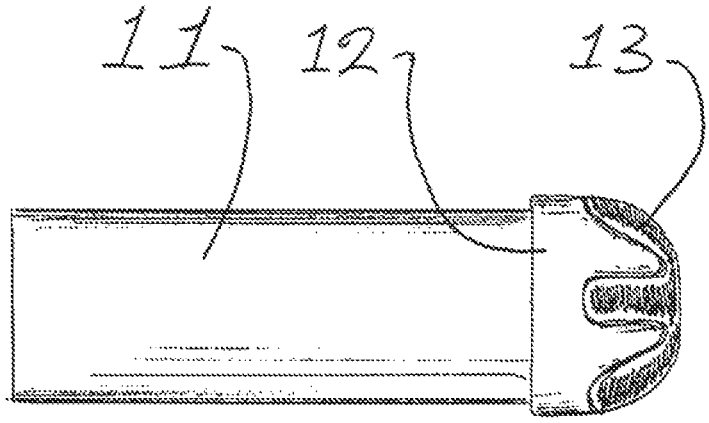
FIG. 7 is an embodiment of a projectile which is Velcro-tipped.
Figure 8:
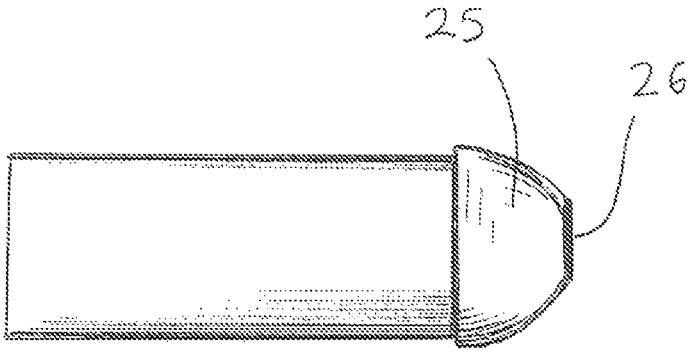
FIG. 8 is a side view of an embodiment of a projectile as a projectile with circular piece of Velcro on the projectile's end.

The forward portion may also be a combination of both foam and Velcro, as seen in FIG. 7, which is an example of a commercially available projectile, where a foam trailing portion 11 is attached to a rubber forward portion 12 which has upon it a section of Velcro 13 attached. The forward portion of FIG. 8 features a small dot of Velcro 26 attached to the front of a dome-style, round tip 25, providing increased aerodynamic efficiency. Contemplated projectiles may also have a helical indentation 15, as shown in FIG. 5, which runs along the length of the trailing portion 14 of the projectile, as a form of rifling, with a twist rate of 20 degrees per inch to 180 degrees per inch. This allows for a spin to be placed on the projectile once the projectile is airborne, and also, depending on the diameter of the trailing portion, allows for a spin to be placed on the projectile from contact with the bore before exiting the blow gun. This spin, similar to that which is induced upon bullets fired from most conventional firearms, affects the projectile in such a way as to increase its accuracy.

The generally helical indentations may be indented with a small blade, cutting along the trailing portion's surface so as to cut out shallow grooves, or they may be melted into the surface depending on material used for the trailing portion, for instance by a soldering iron's heated tip. Said projectiles may also be molded in such a way as to have indentations already present. The forward portion and trailing portion of all said projectiles are aligned axially, and attached to one another with glue if they are not joined in a mold, in the case of n all-plastic projectile made from a single mold and being one piece. The forward portion is primarily for momentum, and the trailing portion is primarily for stability in flight. The tolerance is very close between said projectiles and the bore, which provides a relatively good seal as evidenced in FIG. 2.

The foregoing description of the invention has been presented for purposes of illustration and description and is not intended to be exhaustive or to limit the invention to the precise form disclosed, and obviously many modifications and variations are possible in light of the above teaching.

The invention claimed is:

1. A sport blow gun comprising:

a tube which has a bore, a loading end, and a muzzle end;

the tube having a safety device installed that allows a projectile to be inserted into the tube at the loading end while preventing the projectile from exiting the loading end; and the loading end configured to be blown into by a user to expel the projectile from the muzzle end, wherein the safety device further prevents the projectile from exiting the muzzle end of the tube unless the user blows upon the loading end to expel the projectile, wherein the safety device allows the projectile to only pass in one direction through the tube, wherein the safety device is positioned lengthwise from the exterior of the tube into the interior of the tube through a hole in a wall of the tube, the hole having an angle divergent from the central axis of the tube, wherein the hole is located within a groove which is created in an outer surface of the tube, the groove beginning at the loading end and extending towards the muzzle end, the groove parallel to a central axis of the tube, the hole having an angle divergent from the central axis of the tube and generally pointing from the loading end towards.

2. The sport blow gun of claim 1, wherein the safety device is inserted into the bore through the wall of the tube.

3. The sport blow gun of claim 1, wherein the tube and the safety device are unibody.

4. The sport blow gun of claim 1, wherein the safety device is located at the loading end of the tube.

5. The sport blow gun of claim 1, wherein the sport blow gun includes a plurality of safety devices.

6. The sport blow gun of claim 1, wherein the sport blow gun includes a plurality of safety devices.

7. The sport blow gun of claim 3, wherein the sport blow gun includes a plurality of safety devices and the tube and safety devices are unibody.

8. The sport blow gun of claim 1, wherein the hole is about 0.03-0.08 inches in diameter through which the safety device is inserted, the hole being within approximately 0.35 to 0.85 inches of the loading end, the hole having an angle divergent from the central axis of the tube ranging from about 15 degrees to approximately 30 degrees and generally pointing from the loading end towards the muzzle end, the hole located within a groove which is created in the outer surface of the tube, the groove beginning at the loading end and extending towards the muzzle end about 0.5-1.0 inches from the loading end, the groove parallel to the central axis of the tube, the groove having a width of at least 0.1 inches, the hole having an angle divergent from the central axis of the tube ranging from approximately 15 degrees to approximately 30 degrees and generally pointing from the loading end towards the muzzle end, the safety device comprised of plastic, with a width ranging from about 0.03-0.06 inches, and a height ranging from about 0.03-0.06 inches, and a length ranging from about 0.75-1.0 inches, the safety device being inserted at an angle, the safety device pointing generally towards the muzzle end, the safety device diverging from the central axis of the tube at an angle ranging from about 15-30 degrees.

* * * * *